US006439909B1

(12) United States Patent
Polgar et al.

(10) Patent No.: US 6,439,909 B1
(45) Date of Patent: Aug. 27, 2002

(54) SHIELDED FLOATING ELECTRICAL CONNECTOR

(75) Inventors: Gary E. Polgar, Bolingbrook; Kenneth K. Kotz, Cary; Joseph D. Comerci, Elmhurst, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/877,791

(22) Filed: Jun. 8, 2001

(51) Int. Cl.[7] ..... H01R 16/64

(52) U.S. Cl. ..... 439/248; 439/247; 439/608; 439/610; 439/545

(58) Field of Search ..... 439/247, 248, 439/701, 680–677, 607

(56) References Cited

U.S. PATENT DOCUMENTS

| | | | | | |
|---|---|---|---|---|---|
| 3,995,947 | A | * | 12/1976 | Lightner et al. | |
| 4,580,862 | A | | 4/1986 | Johnson | 339/64 |
| 4,810,215 | A | | 3/1989 | Kaneko | 439/845 |
| 4,909,748 | A | | 3/1990 | Kozono et al. | 439/247 |
| 4,963,098 | A | | 10/1990 | Myer et al. | 439/76 |
| 5,007,862 | A | * | 4/1991 | Defibaugh et al. | 439/607 |
| 5,073,127 | A | * | 12/1991 | Daly et al. | 439/473 |
| 5,205,755 | A | | 4/1993 | Douty et al. | 439/247 |
| 5,252,087 | A | * | 10/1993 | Spinnato et al. | 439/247 |
| 5,286,222 | A | | 2/1994 | Yagi et al. | 439/607 |
| 5,306,168 | A | | 4/1994 | Kunishi et al. | 439/248 |
| 5,516,303 | A | * | 5/1996 | Yohn et al. | 439/248 |
| 5,622,511 | A | * | 4/1997 | Jarett | 439/248 |
| 5,755,584 | A | | 5/1998 | Kodama et al. | 439/248 |
| 5,766,041 | A | * | 6/1998 | Morin et al. | 439/609 |
| 5,769,652 | A | | 6/1998 | Wider | 439/248 |
| 6,017,245 | A | * | 1/2000 | Karir | 439/610 |
| 6,159,030 | A | | 12/2000 | Gawron et al. | 439/247 |
| 6,206,712 | B1 | * | 3/2001 | Norizuki et al. | 439/247 |
| 6,206,730 | B1 | * | 3/2001 | Avery et al. | 439/609 |
| 6,210,228 | B1 | * | 4/2001 | Simmel et al. | 439/609 |
| 6,231,384 | B1 | * | 5/2001 | Kuo | 439/545 |

* cited by examiner

*Primary Examiner*—P. Austin Bradley
*Assistant Examiner*—L Tsukerman
(74) *Attorney, Agent, or Firm*—Stephen Z. Weiss

(57) ABSTRACT

A shielded floating panel mounted electrical connector includes a dielectric housing having a front mating end and a rear terminating end. The front mating end is designed for mating with a complementary mating connector in a mating direction. A metal shell is mounted about at least the rear terminating end of the dielectric housing. The shell mounts the electrical connector in an opening in and rigidly fixed to a panel. The housing is complementarily engaged within the shell to provide for relative floating movement therebetween in a direction transversely of the mating direction.

15 Claims, 4 Drawing Sheets

SHIELDED FLOATING ELECTRICAL CONNECTOR

FIELD OF THE INVENTION

This invention generally relates to the art of electrical connectors and, particularly, to a shielded electrical connector for mounting in a panel and providing floating movement between a housing of the connector and the panel.

BACKGROUND OF THE INVENTION

Floating type electrical connectors have been used to compensate for positional displacement between a movable electrical connector or device and a fixed connector such as a connector mounted in an opening in a panel. For instance, in such applications as automotive applications, a pair of electrical connectors may have to be mated beneath a dashboard or at other "blind" locations wherein it is desirable to have a degree of floating movement of the fixed connector to make it easier to align the movable connector therewith during mating. In other applications, floating movement is desirable simply to accommodate manufacturing or assembly tolerances when a pair of connectors are mounted to different structural components of the appliance.

Heretofore, when prior art connectors have been mounted in panels with floating movement, the entire connector moves relative to the panel. When the entire connector moves, the wires leading to the connector, such as power or data lines, also must move. This places a strain on the wires and/or can cause damage to or break the plastic housing. In addition, because of the added weight and stiffness of the wires or other hardware that might be coupled to the connector, the floating movement of the connector is difficult and may even be prevented if excessive extraneous forces are placed on the floating connector. These problems are magnified when a thick cast shield or shell is mounted about a dielectric housing of the connector. Extraneous weights or limitations further might be applied to the shell.

The present invention is directed to solving these various problems in a shielded floating connector wherein the shielding shell is rigidly fixed to a panel to absorb all extraneous forces on the floating connector. The connector, in turn, has a dielectric housing which floats relative to the fixed shell and, thereby, floats relative to the panel.

SUMMARY OF THE INVENTION

An object, therefore, of the invention is to provide a new and improved shielded, floating panel mounted electrical connector.

In the exemplary embodiment of the invention, the floating connector includes a dielectric housing having a front mating end and a rear terminating end. The front mating end is designed for mating with a complementary mating connector in a mating direction. A metal shell is mounted about at least the rear terminating end of the dielectric housing. The shell has means for mounting the electrical connector in an opening in a panel. Complementary interengaging floating means are provided between the metal shell and the dielectric housing to provide for relative floating movement therebetween in a direction transversely of the mating direction.

According to one aspect of the invention, the metal shell is a die cast metal component and comprises a pair of shell halves sandwiching the dielectric housing therebetween. The shell halves combine to define an interior cavity within which the terminating end of the dielectric housing is exposed. The shell halves also define an access hole communicating with the cavity and through which appropriate electrical wires can extend to the terminating end of the housing. The shell halves have outwardly projecting flanges engageable with a back side of the panel, along with lips projecting forwardly through the opening in the panel. The lips of the shell halves form an enlarged aperture for receiving the dielectric housing with floating movement therebetween. The housing also includes a plurality of polarizing ribs engageable within a plurality of polarizing slots in the lips.

According to another aspect of the invention, the complementary interengaging floating means are provided by flange means projecting outwardly of the dielectric housing into groove means inside the metal shell. The groove means are sized larger than the flange means to provide the floating movement between the housing and the shell. In the preferred embodiment, the flange means comprise a circumferential flange about the dielectric housing positionable within a continuously circumferential groove inside the metal shell.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
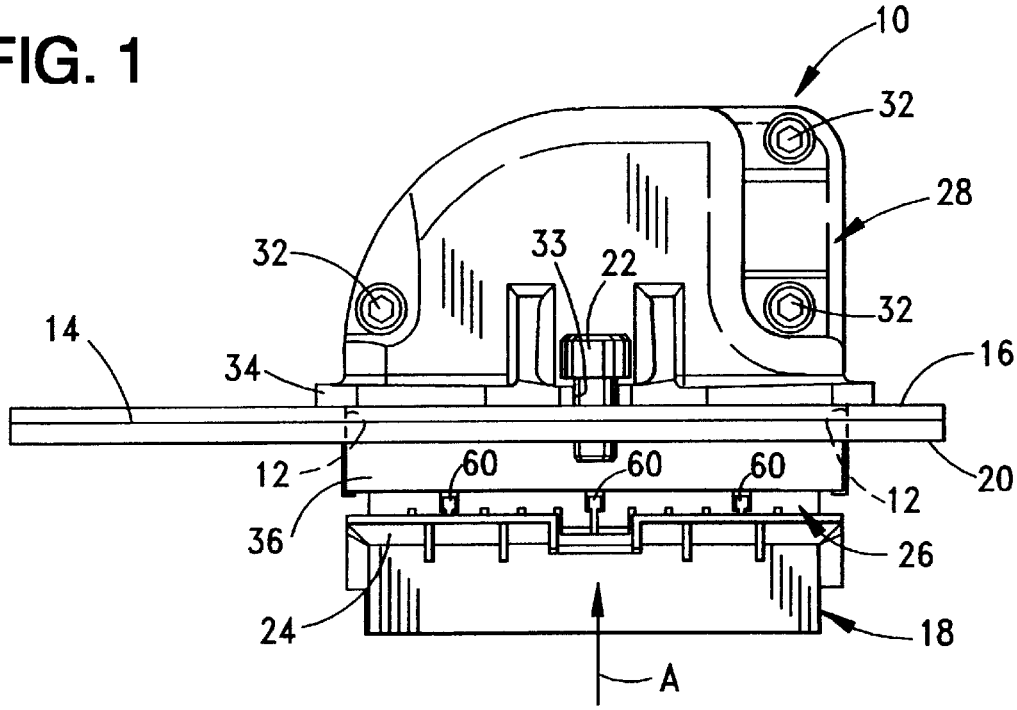
FIG. 1 is a top plan view of a shielded floating panel mounted electrical connector according to the invention, mounted through a panel and mated with a complementary mating connector.

Referring to the drawings in greater detail, and first to FIG. 1, the invention is embodied in a shielded, floating panel mounted electrical connector, generally designated 10, mounted within an opening 12 in a panel 14 or other support structure. Connector 10 is mounted to a back side 16 of the panel, and a complementary mating connector, generally designated 18, is mateable with the connector on an opposite or front side 20 of the panel in a mating direction indicated by arrow "A". A pair of fasteners 22 fix the connector to the panel. Mating connector 18 has an outwardly flared or funnel-shaped flange 24 to facilitate aligning the mating connector with a mating portion of floating panel mounted connector 10.

Figure 2:
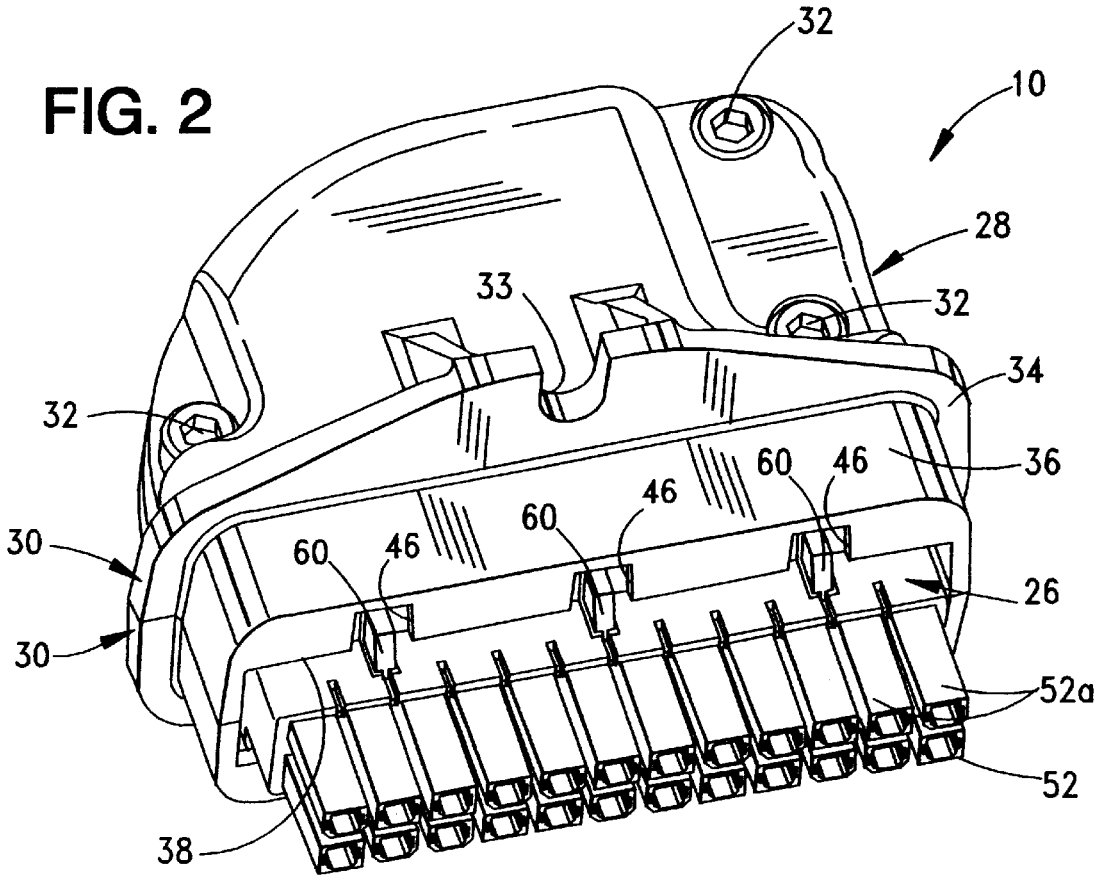
FIG. 2 is a perspective view of the connector removed from the panel and without the mating connector.

Referring to FIG. 2 in conjunction with FIG. 1, floating connector 10 generally includes a dielectric housing, generally designated 26, floatingly mounted within a metal shell, generally designated 28. The metal shell, itself, is formed by a pair of die cast metal shell halves, generally designated 30, which sandwich dielectric housing 26 therebetween. The shell halves are secured together by a plurality of fasteners 32 such as appropriate bolts or screws. The shell halves have notches 33 for receiving fasteners 22 (FIG. 1).

Figure 3:
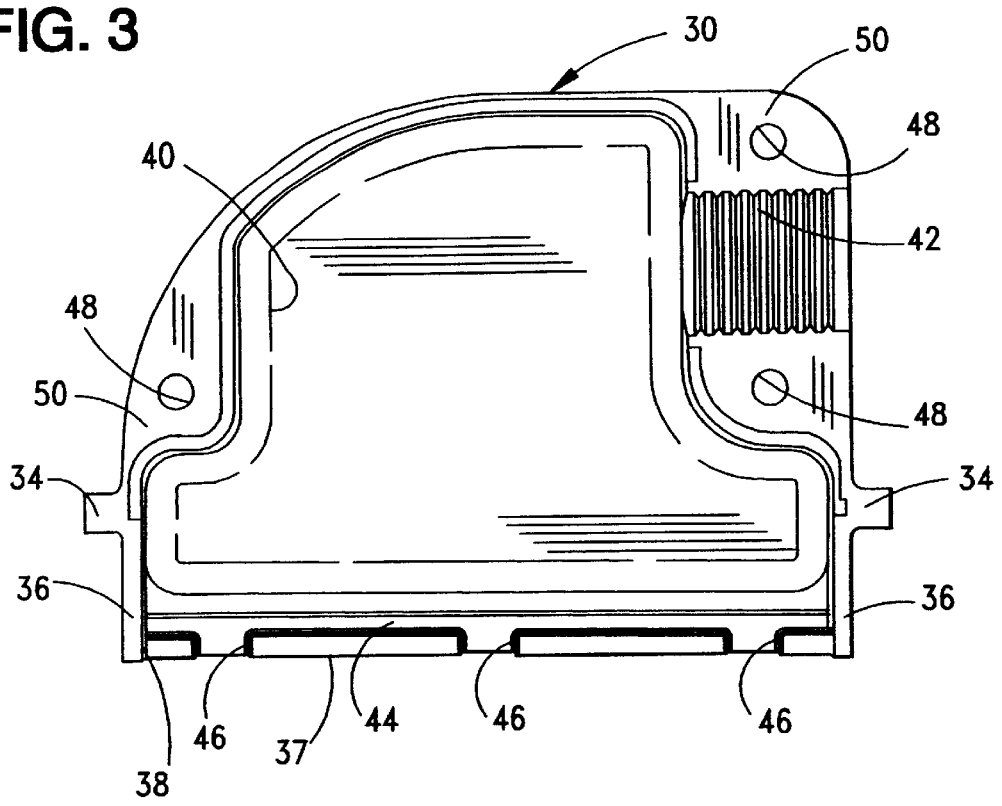
FIG. 3 is a plan view of the bottom metal shell half as viewed in FIG. 2.

Referring to FIG. 3, each metal shell half 30 includes an outwardly projecting flange 34 which is engageable with or abuts back side 16 of panel 14 when fasteners 22 are used to secure the connector to the panel as described above in relation to FIG. 1. A forwardly projecting lip 36 projects through opening 12 in the panel. The lips of the two shell halves combine to form a ledge 37 which defines an aperture 38 (FIG. 2) through which dielectric housing 26 projects. The shell halves combine to form an interior cavity 40 (FIG. 3) within which a terminating end of dielectric housing 26 is exposed, as will be seen hereinafter. The shell halves also combine to form an access hole 42 through which appropriate electrical wires can extend to the terminating end of the housing. It can be seen that the hole is internally serrated or threaded to provide a positive grip on the wires. The that a good electrical contact is made between the shell halves and the braided shield of the cable to complete a shield path to ground. Aperture 38 (FIG. 2) formed by the ledge 37 of the two shell halves is larger than housing 26 so that the housing floats therewithin.

Figure 6:
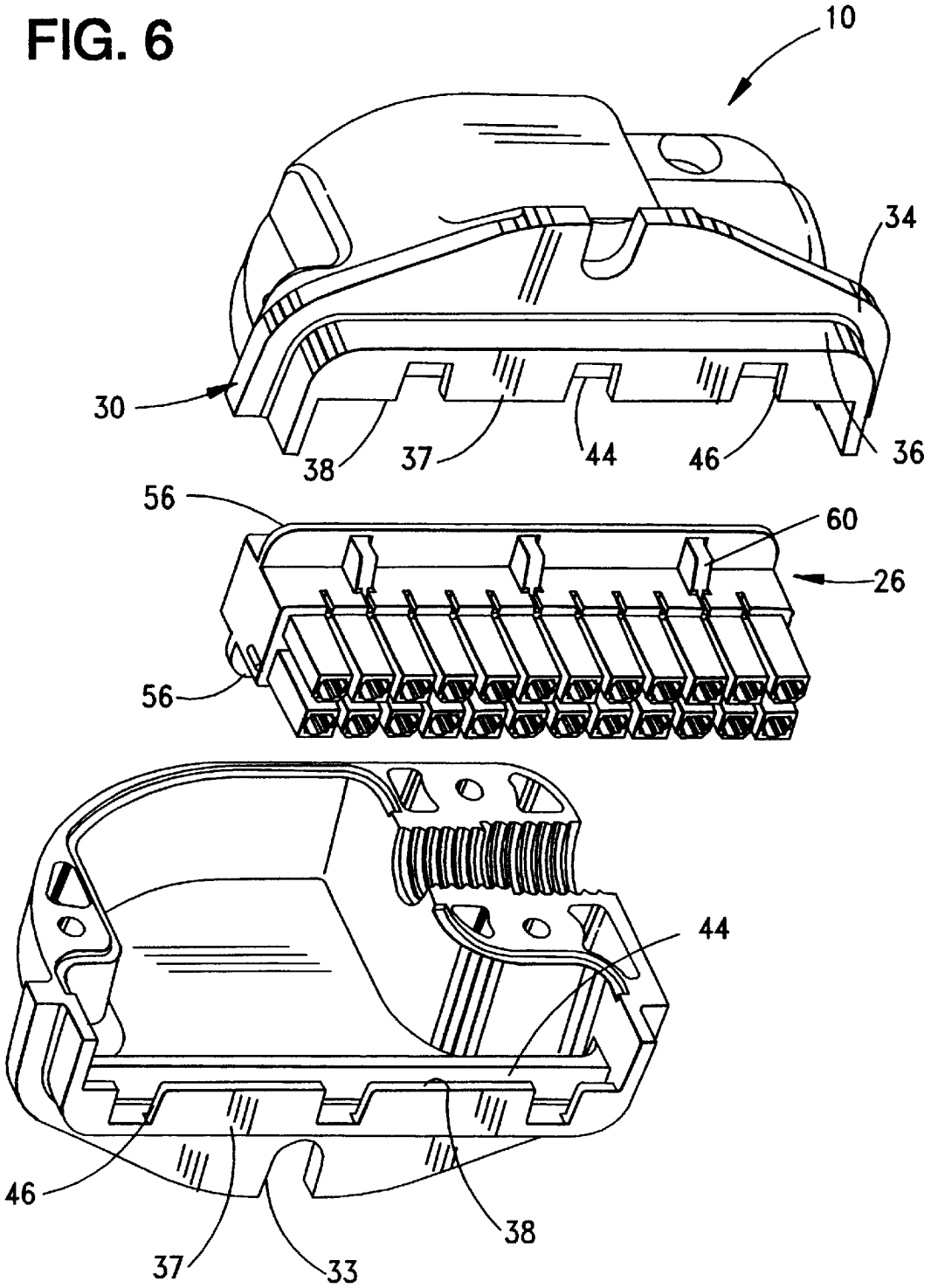
FIG. 6 is an exploded view of of the connector in FIG. 2.

Still referring to FIG. 3, each shell half 30 includes a transverse groove 44 inside lip 36 within housing-receiving aperture 38. A plurality of polarizing slots 46 defined by the ledge 37 communicate with groove 44 and open forwardly of lip 36. Finally, a plurality of fastening holes 48 are formed in reinforcing flanges 50 of the metal shell halves for receiving fasteners 32. FIG. 6 more clearly shows the relative engagement between flange 56 and slot 44 and the relative engagement between ribs 60, which project from dielectric housing 26, and slots 46, which are defined by ledge 37.

Figure 4:
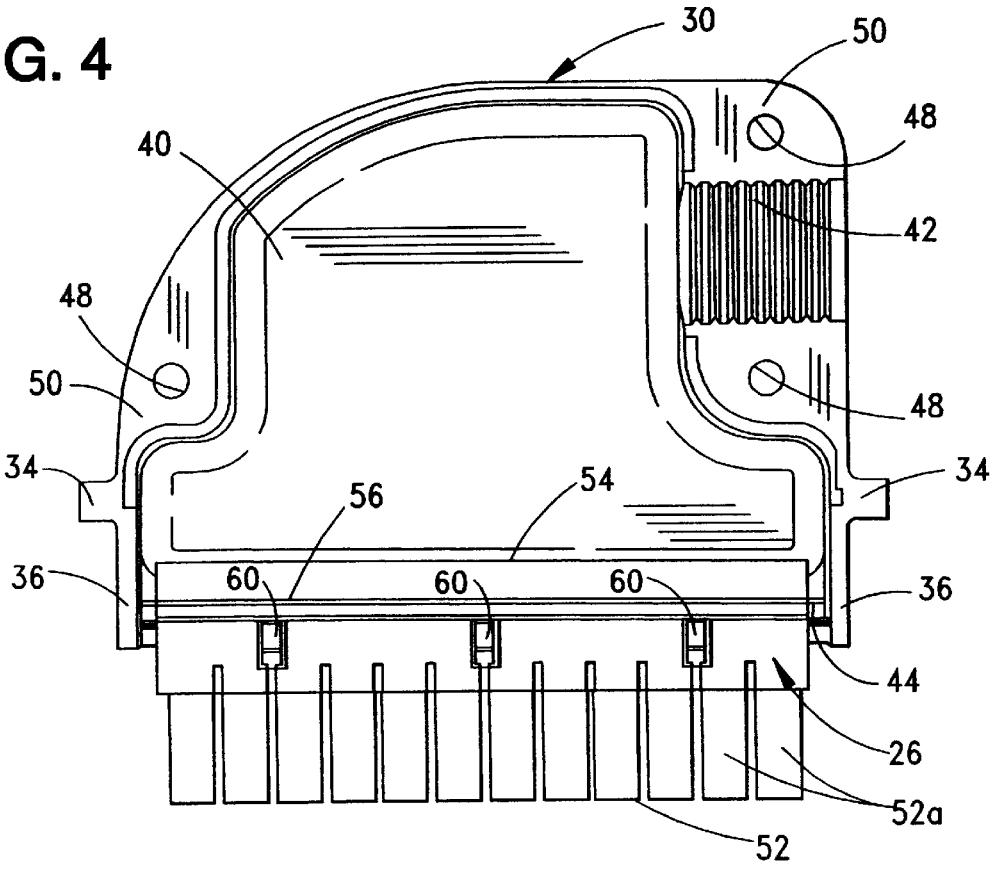
FIG. 4 is a view similar to that of FIG. 3, with the dielectric housing positioned on the shell half.

Referring to FIG. 4, dielectric housing 26 is shown positionable within one of the shell halves 30, as during assembly of floating connector 10. For instance, shell half 30 in FIG. 4 may be the bottom shell half shown in FIG. 3.

Dielectric housing 26 is shown in FIG. 4 as including a front mating end 52 and a rear terminating end 54. Actually, the front mating end includes a plurality of silos 52*a* within which are mounted appropriate conductive terminals of the connector. Front mating end 52 of the dielectric housing is designed for mating with complementary mating connector 18 as shown in FIG. 1. Rear terminating end 54 of the dielectric housing is exposed within cavity 40 of the metal shell whereby the electrical wires which enter the shell through access hole 42 can be terminated to the conductive terminals within the dielectric housing. The electrical wires are not shown in the drawings to avoid cluttering the illustration.

According to the invention, dielectric housing 26 includes a circumferential flange 56 which seats within groove 44 inside the metal shell. In essence, shell halves 30 both include one-half of a continuous circumferential groove which circumscribes dielectric housing 26 and embraces circumferential flange 56 about the entire dielectric housing. The circumferential groove within the shell is sized larger than the flange circumscribing the dielectric housing to provide a given degree of floating movement between the housing and the metal shell. Therefore, the metal shell can be rigidly fixed to the panel and absorb all extraneous forces on the connector, such as the forces from the electrical wires extending through access hole 42. Housing 26, in turn, floats relative to the shell and, therefore, floats relative to panel 14 to facilitate mating the connector with complementary mating connector 18 (FIG. 1).

As best seen in FIG. 2, dielectric housing 26 includes a plurality of polarizing ribs 60 which are positionable within polarizing slots 46 in the metal shell as described above in relation to FIG. 3. The polarizing slots are sized larger than the polarizing ribs to accommodate the relative floating movement between the dielectric housing and the metal shell. The dielectric housing may be unitarily molded of plastic material or the like, and the polarizing ribs, as well as outwardly projecting flange 56, may be molded integrally therewith. Sets of polarizing ribs and slots are located at both opposite sides of the connector as seen in FIGS. 5A–5C, with the sets of ribs and slots being located differently on opposite sides of the connector, for polarization purposes so that the housing can be mounted in the shell in only one orientation.

Figure 5A:
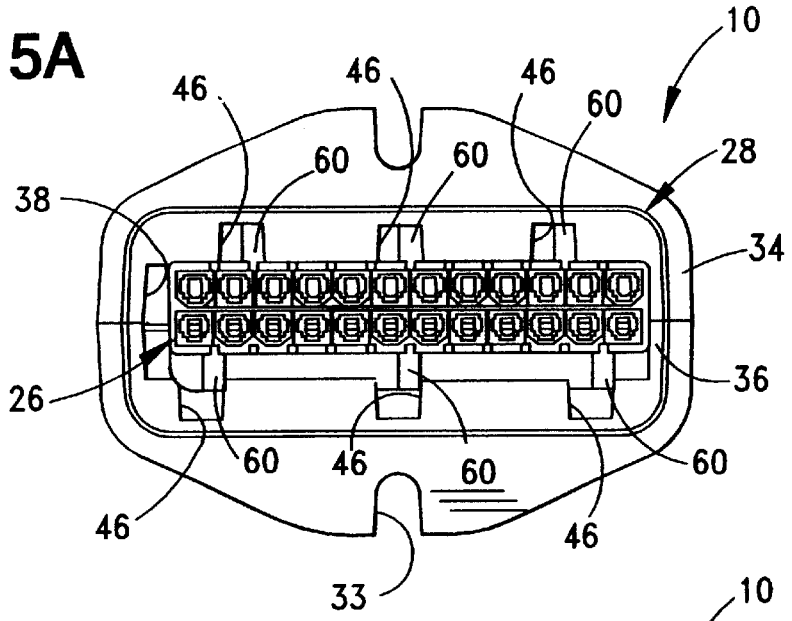
FIGS. 5A–5C are front elevational views of the connector, with the housing in various positions of floating movement relative to the shell.
Figure 5B:
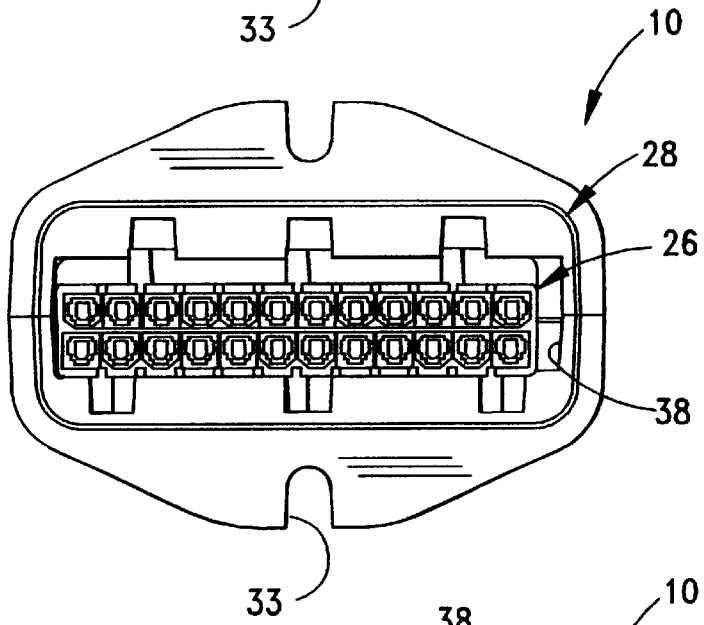
Figure 5C:
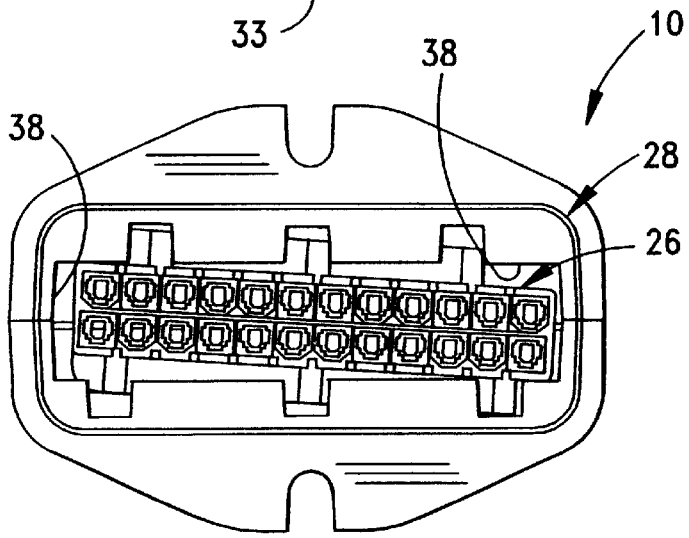

Finally, FIGS. 5A–5C show different positions of relative floating movement between dielectric housing 26 and metal shell 28 of connector 10. This floating movement is allowed because the entire dielectric housing is smaller in all directions than aperture 38 in the metal shell, along with circumferential flange 56 on the housing being smaller than groove 44 within the shell, as well as polarizing ribs 60 being smaller than polarizing slots 46.

FIGS. 5A–5C show examples of the relative floating movement between dielectric housing 26 and metal shell 28 of connector 10. Of course, the number of relative positions, in essence, is infinite since the housing is free to move within the shell as restricted only by the differential sizes of the housing and aperture 38 within the shell. For instance, FIG. 5A shows an extreme upper position of dielectric housing 26 within aperture 38, and with the housing at the far right-hand end of the aperture as viewed in the drawing. FIG. 5B shows the housing at its extreme bottom and far left position within aperture 38. FIG. 5C shows the housing tilted within the aperture, with the left-hand end of the housing tilted upwardly and the right-hand end of the housing tilted downwardly.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded floating panel mounted electrical connector, comprising:

a dielectric housing having a front mating end, a rear terminating end, and a circumferential flange located therebetween, the front mating end being designed for mating with a complementary mating connector in a mating direction;

a metal shell mounted rigidly to a panel about at least the rear terminating end of the dielectric housing, the shell having means for mounting the electrical connector in an opening in a panel, the metal shell further including lips projecting through the opening in the panel the lips forming a forwardly extending enlarged aperture for receiving a portion of the dielectric housing and a ledge defining the enlarged aperture; and means for providing a complementary interengaging relative floating movement between the metal shell and the dielectric housing in a direction transversely of said mating direction, said means including the ledge, defining the enlarged aperture in the lip, and the circumferential flange of the dielectric housing slidably engageable with one another.

2. The shielded floating panel mounted electrical connector of claim 1 wherein said metal shell comprises a pair of shell halves sandwiching the dielectric housing therebetween.

3. The shielded floating panel mounted electrical connector of claim 1 wherein said metal shell includes an interior cavity within which the terminating end of the dielectric housing is exposed, and the shell has an access hole communicating with the cavity and through which appropriate electrical wires can extend to the terminating end of the housing.

4. The shielded floating panel mounted electrical connector of claim 1 wherein said metal shell has an outwardly projecting flange engageable with a back side of the panel.

5. The shielded floating panel mounted electrical connector of claim 1 wherein said dielectric housing includes a plurality of polarizing ribs engageable within a plurality of polarizing slots defined by the ledge.

6. The shielded floating panel mounted electrical connector of claim 1 wherein said shell is a die cast metal component.

7. A shielded floating panel mounted electrical connector, comprising:

a dielectric housing having a front mating end and a rear terminating end, the front mating end being designed for mating with a complementary mating connector in a mating direction, the housing including a flange projecting outwardly therefrom; and a metal shell including a pair of shell halves about at least the rear terminating end of the dielectric housing, the shell halves forming an aperture for receiving the dielectric housing, the aperture being larger than the housing to provide for relative floating movement therebetween in a direction transversely of said mating direction, the shell having a groove for receiving the flange of the housing, and the shell having means for mounting the electrical connector in an opening and rigidly fixed to a panel.

8. The shielded floating panel mounted electrical connector of claim 7 wherein said metal shell halves define an interior cavity within which the terminating end of the dielectric housing is exposed, along with an access hole communicating with the cavity and through which appropriate electrical wires can extend to the terminating end of the housing.

9. The shielded floating panel mounted electrical connector of claim 7 wherein said metal shell halves include an outwardly projecting flange engageable with a back side of the panel and a lip projecting forwardly through the opening in the panel.

10. The shielded floating panel mounted electrical connector of claim 9 wherein said lip forms said aperture for receiving the dielectric housing.

11. The shielded floating panel mounted electrical connector of claim 10 wherein said dielectric housing includes a plurality of polarizing ribs engageable within a plurality of polarizing slots in said lip.

12. The shielded floating panel mounted electrical connector of claim 7 wherein said shell halves comprise die cast metal components.

13. The shielded floating panel mounted electrical connector of claim 7 wherein the flange on said dielectric housing comprises a circumferential flange about the housing received in a circumferential groove within the metal shell.

14. A shielded floating panel mounted electrical connector, comprising:

a dielectric housing having a front mating end and a rear terminating end, the front mating end being designed for mating with a complementary mating connector in a mating direction;

a metal shell mounted rigidly to a panel about at least the rear terminating end of the dielectric housing, the shell having means for mounting the electrical connector in an opening in the panel; and means for providing a complementary interengaging relative floating movement between the metal shell and the dielectric housing in a direction transversely of said mating direction, said means for providing complementary interengaging relative floating movement comprising a flange projecting outwardly of the dielectric housing into a groove inside the metal shell, the groove being sized larger than the flange to provide said relative floating movement between the housing and the shell.

15. The shielded floating panel mounted electrical connector of claim 14 wherein said flange is circumferential about the dielectric housing.

* * * * *